US011440758B2

(12) United States Patent
Bär et al.

(10) Patent No.: US 11,440,758 B2
(45) Date of Patent: Sep. 13, 2022

(54) TRANSPORT DEVICES FOR A SHEET-FORMAT SUBSTRATE AND METHOD FOR TRANSPORTING AT LEAST ONE SHEET-FORMAT SUBSTRATE

(71) Applicant: KOENIG & BAUER AG, Würzburg (DE)

(72) Inventors: Bernhard Bär, Worms-Pfeddersheim (DE); Alexander Soller, Worms (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/438,593

(22) PCT Filed: Jan. 17, 2020

(86) PCT No.: PCT/EP2020/051158

§ 371 (c)(1),
(2) Date: Sep. 13, 2021

(87) PCT Pub. No.: WO2020/200528

PCT Pub. Date: Oct. 8, 2020

(65) Prior Publication Data

US 2022/0097988 A1 Mar. 31, 2022

(30) Foreign Application Priority Data

Apr. 4, 2019 (DE) ..... 10 2019 108 874.7

(51) Int. Cl.
*B65H 9/06* (2006.01)
*B65H 5/36* (2006.01)

(52) U.S. Cl.
CPC ..... *B65H 5/36* (2013.01); *B65H 9/06* (2013.01); *B65H 2301/42134* (2013.01);
(Continued)

(58) Field of Classification Search
CPC ... B65H 5/36; B65H 9/06; B65H 2301/42134
See application file for complete search history.

(56) References Cited

U.S. PATENT DOCUMENTS 3,907,278 A * 9/1975 Jaton ..... B65H 3/50 271/11
4,619,571 A 10/1986 Peiffer
(Continued)

FOREIGN PATENT DOCUMENTS

DE 3115925 C1 12/1982
DE 102017208745 A1 11/2017
(Continued)

OTHER PUBLICATIONS

International Search Report of PCT/EP2020/051158 dated May 28, 2020.

*Primary Examiner* — Howard J Sanders
(74) *Attorney, Agent, or Firm* — Mattingly & Malur, PC

(57) ABSTRACT

A transport device for a sheet-format substrate has at least one first substrate feed device and has at least one second substrate feed device. The at least one second substrate feed device comprises at least one forward stop and at least one singulating device. At least one substrate guiding device is arranged between the at least one first substrate feed device and the at least one second substrate feed device. The at least one substrate guiding device has at least one directing element. The at least one directing element is mounted such that it is movable or is moved in two different directions independently of one another.

12 Claims, 8 Drawing Sheets

(52) U.S. Cl.
CPC ..... *B65H 2701/11312* (2013.01); *B65H 2701/1762* (2013.01); *B65H 2801/21* (2013.01)

(56) References Cited

U.S. PATENT DOCUMENTS

| | | | | | |
|---|---|---|---|---|---|
| 5,205,704 | A * | 4/1993 | Frost | B65H 29/66 | 271/238 |
| 5,575,463 | A * | 11/1996 | Parkander | B65H 83/02 | 270/52.02 |
| 7,516,950 | B2 * | 4/2009 | Herde | B65H 29/66 | 271/3.12 |
| 10,493,746 | B2 * | 12/2019 | Ziegenbalg | B41F 23/08 | |
| 2010/0044948 | A1 | 2/2010 | Sardella et al. | | |
| 2020/0223237 | A1 * | 7/2020 | Bernard | B41J 13/0027 | |

FOREIGN PATENT DOCUMENTS

| | | | |
|---|---|---|---|
| FR | 2538357 | A1 | 6/1984 |
| JP | 4869267 | A | 9/1973 |

* cited by examiner

TRANSPORT DEVICES FOR A SHEET-FORMAT SUBSTRATE AND METHOD FOR TRANSPORTING AT LEAST ONE SHEET-FORMAT SUBSTRATE

CROSS-REFERENCE TO RELATED APPLICATION

This application is the U.S. national phase, under 35 USC § 371, of PCT/EP2020/051158, filed Jan. 17, 2020; published as WO 2020/200528 A1 on Oct. 8, 2020, and claiming priority to DE 10 2019 108 874.7, filed Apr. 4, 2019, the disclosures of which are expressly incorporated herein, in their entireties, by reference.

FIELD OF THE INVENTION

The present invention relates to transport devices for a sheet-format substrate and to a method for transporting at least one sheet-format substrate. The transport device for a sheet-format substrate has at least one first substrate feed device and has at least one second substrate feed device. The at least one second substrate feed device comprises at least one forward stop and at least one singulating device. At least one substrate guiding device is located between the at least one first substrate feed device and the at least one second substrate feed device. The at least one substrate guiding device has at least one directing element. The at least one directing element is mounted such that it is movable, or is moved, in two different directions independently of one another. The at least one directing element may be mounted operatively connected to at least one first linear guide and to at least one second linear guide. A method is provided for transporting at least one such sheet-format substrate using the at least one first substrate feed device and the at least one second substrate feed device, wherein the at least one second substrate feed device comprises the at least one forward stop and the at least one singulating device. Downstream of the at least one first substrate feed device and upstream of the at least one second substrate feed device, the at least one substrate is transported by at least one substrate guiding device. The at least one substrate guiding device has at least one directing element. The at least one directing element is moved in two different directions independently of one another. The at least one substrate guiding device has at least one supporting element.

BACKGROUND OF THE INVENTION

A number of different printing methods are used in printing presses. Non-impact printing (NIP) methods are understood as printing methods that do not require a fixed, that is to say, a physically unchanging printing form. Such printing methods can produce different printed images in each printing operation. Examples of non-impact printing methods include ionographic methods, magnetographic methods, thermographic methods, electrophotography, laser printing, and in particular inkjet printing methods. Such printing methods typically involve at least one image producing device, for example at least one print head. In the inkjet printing method, such a print head is configured, for example, as an inkjet print head and has at least one and preferably a plurality of nozzles, by means of which at least one printing fluid, for example in the form of ink droplets, can be transferred selectively onto a printing material. Alternative printing methods use fixed printing forms, for example gravure printing methods, planographic printing methods, offset printing methods and letterpress printing methods, in particular flexographic printing methods. Depending on the number of copies and/or other requirements such as print quality, for example, a non-impact printing method or a printing method involving a fixed printing form may be preferred.

A processing machine or sheet processing machine is preferably in the form of a printing press or sheet-fed printing press. The processing machine is preferably in the form of a processing machine for processing corrugated cardboard, in particular corrugated cardboard sheets, i.e. preferably in the form of a corrugated cardboard processing machine and/or corrugated cardboard sheet processing machine. More preferably, the sheet processing machine is in the form of a sheet-fed printing press for coating and in particular for printing corrugated cardboard sheets, i.e. a sheet-fed corrugated cardboard printing press. Alternatively or additionally, the processing machine is in the form of a die-cutting machine and/or sheet-fed die-cutting machine and/or sheet-fed rotary die-cutting machine. The processing machine preferably in the form of a sheet-fed printing press preferably has at least one and more preferably at least two units configured as modules. The at least one module and more preferably each of the at least two modules preferably has at least one drive dedicated uniquely to it. At least one of the at least two modules is preferably configured as a processing module, in particular as a coating module.

Alternatively, the processing machine is in the form of a roll-fed processing machine and/or web-fed processing machine and/or in the form of a roll-fed coating machine and/or web-fed coating machine and/or in the form of a roll-fed printing press and/or web-fed printing press. For example, the processing machine is alternatively or additionally configured as a corrugated cardboard processing machine and/or corrugated cardboard web processing machine and/or as a roll-fed die-cutting machine.

A sheet-fed printing press having a first substrate feed device and a second substrate feed device is known from DE 10 2017 208 745 A1.

A substrate feed device which has a holder for the substrate is known from US 2010/0044948 A1.

A method and a device for stacking sheets is known from DE 31 15 925 C1. Said document discloses a sheet feed using a plurality of substrate feed and/or substrate guiding devices. Such a substrate guiding device is configured, for example, as a singulating device and/or turning device and/or conveyor belt. The individual devices have a plurality of elements for supporting and/or for conveying the sheets forward.

From JP S48 69267 A, a transport device for a sheet-format substrate having a first and a second substrate feed device is known. The second substrate feed has a forward stop and singulates the sheets. A substrate guiding device with a directing element is located between the first and the second substrate feed devices. The directing element can be moved in two different directions independently of one another. Said document further discloses a spring assembly which can generally be regarded as a supporting element.

From FR 2 538 357 A1, a transport device for a sheet-format substrate having a first and a second substrate feed device is known. The second substrate feed has a forward stop and singulates the sheets. A plurality of elements which can be regarded as a substrate guiding device with a directing element are located between the first and the second substrate feed device. The directing element can be moved forward and backward on a linear guide.

The object of the invention is to devise transport devices for a sheet-format substrate and a method for transporting at least one sheet-format substrate.

SUMMARY OF THE INVENTION

The object is attained according to the present invention by the provision that the at least one directing element has at least one directing bar which is mounted for rotational displacement. The at least one directing element also has at least one bearing rail. The least one bearing rail has at least one bearing element in the transverse direction. The at least one bearing element is arranged protruding away from the at least one bearing rail which points at least in the direction of transport or at least in a direction that points towards the at least one second substrate feed device. The at least one supporting element of the at least one substrate guiding device supports the at least one substrate against deflection or bending or for an adjustment to the thickness of the at least one substrate for feeding to the at least one second substrate feed device.

The advantages to be achieved with the present invention consist, in particular, in that a substrate guiding device is located between a first substrate feed device and a second substrate feed device and in that the sheet feed can be flexibly adjusted for sheets of different sizes, in particular corrugated cardboard sheets. In particular, the additional substrate feed device enables even very large sheets, for example sheets measuring 1.7 by 2.3 meters, to be processed. In addition, with the flexible adjustment of the substrate guiding device, the portfolio of processable substrates can be increased.

In particular, the flexible adjustment enables a positionally accurate feeding and/or guidance to the downstream substrate feed device. This is necessary and/or a requirement in particular for the accurate processing of the substrate in subsequent processing steps.

The displacement of the substrate guiding device by means of drives allows the substrate guiding device to be adjusted without manual intervention. The sheet format of a specific job can be saved, for example, and this displacement can then be retrieved again, for example automatically. In particular, operation is simplified substantially for a system operator.

With the singulating device, which has a bearing rail and/or finger rail, the sheets can be conveyed individually or at least pre-singulated to the substrate feed device. In particular, pre-singulation enables weight to be removed and facilitates feeding to a machine downstream. This also facilitates further singulation.

BRIEF DESCRIPTION OF THE DRAWINGS

Exemplary embodiments of the invention are illustrated in the set of drawings and will be described in greater detail in the following.

The drawings show.

DESCRIPTION OF THE PREFERRED EMBODIMENT

Figure 1:
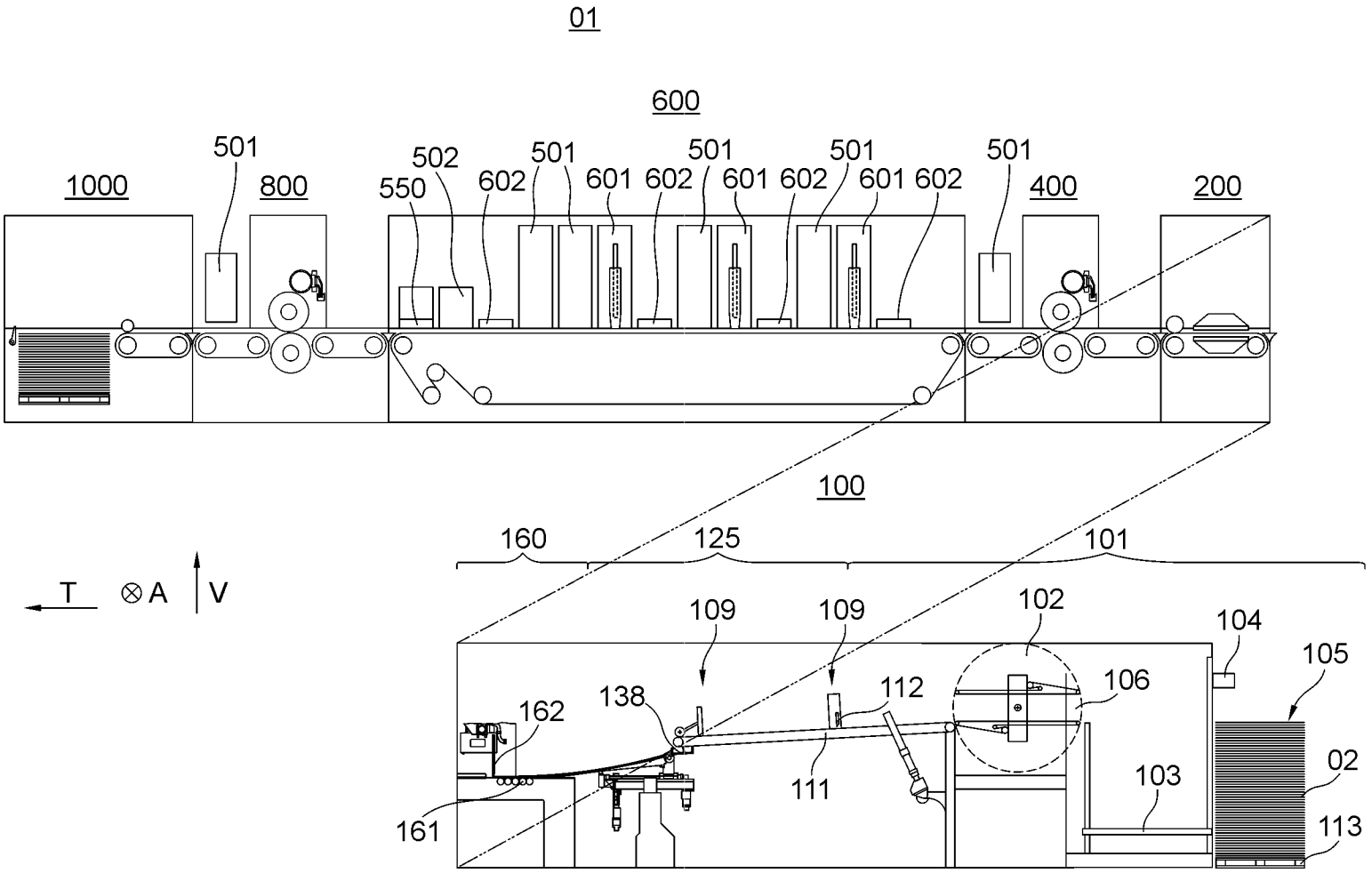
FIG. 1 a schematic diagram of a sheet-fed printing press with at least one substrate guiding device.
Figure 2A:
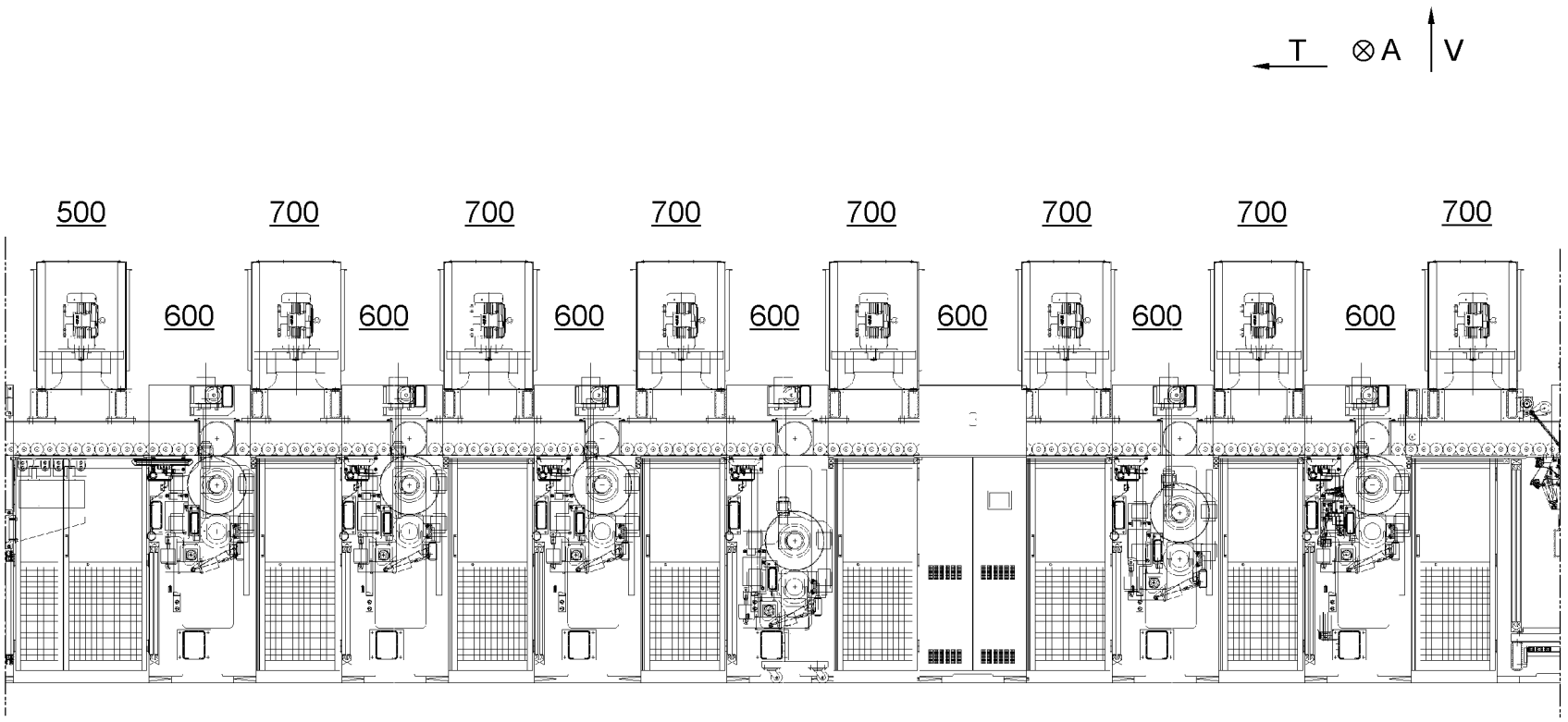
FIG. 2*a* a first detail of a schematic diagram of the sheet-fed printing press of FIG. 1.
Figure 2B:
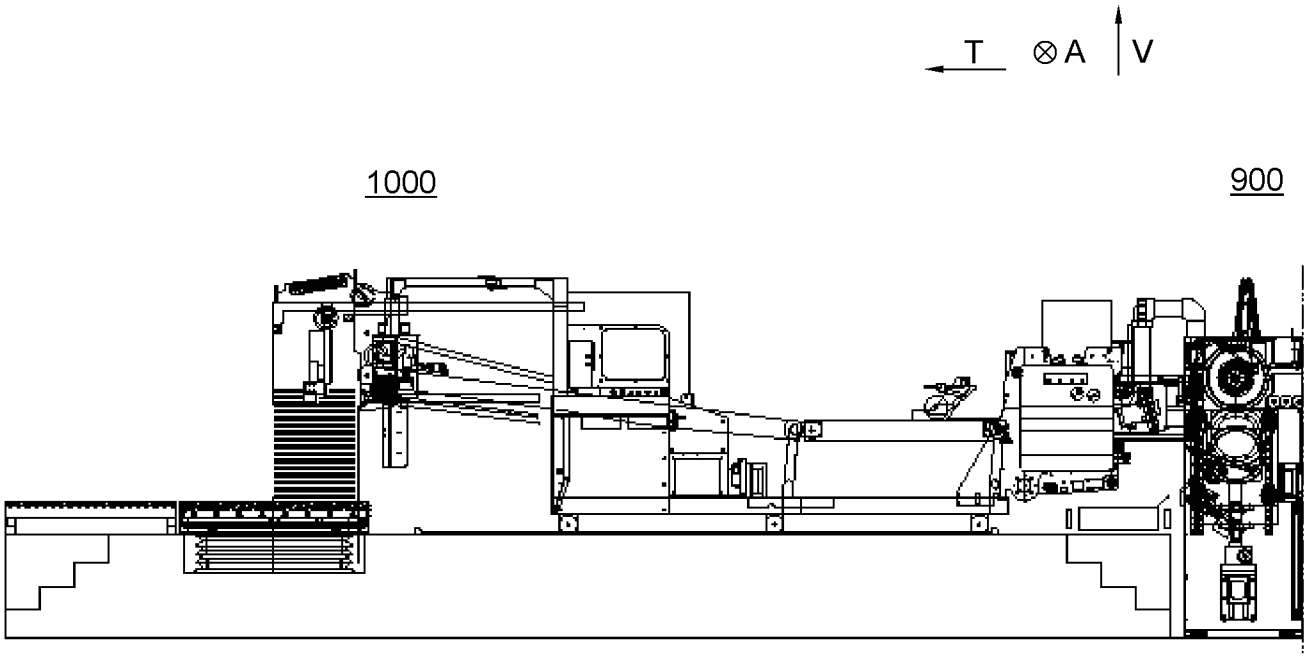
FIG. 2*b* a further detail of a schematic diagram of the sheet-fed printing press of FIG. 1.
Figure 3:
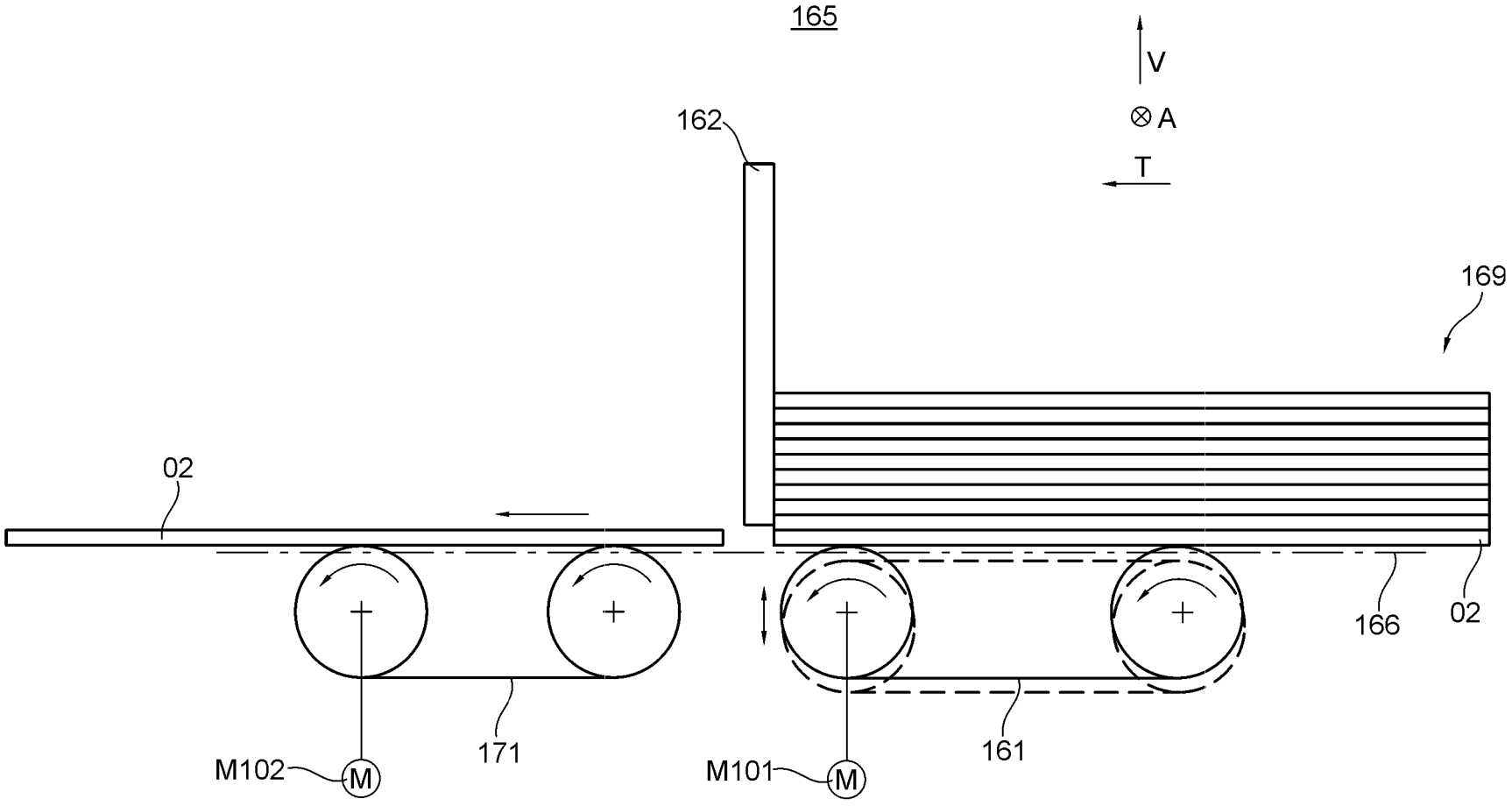
FIG. 3 a schematic diagram of the singulating device.
Figure 4:
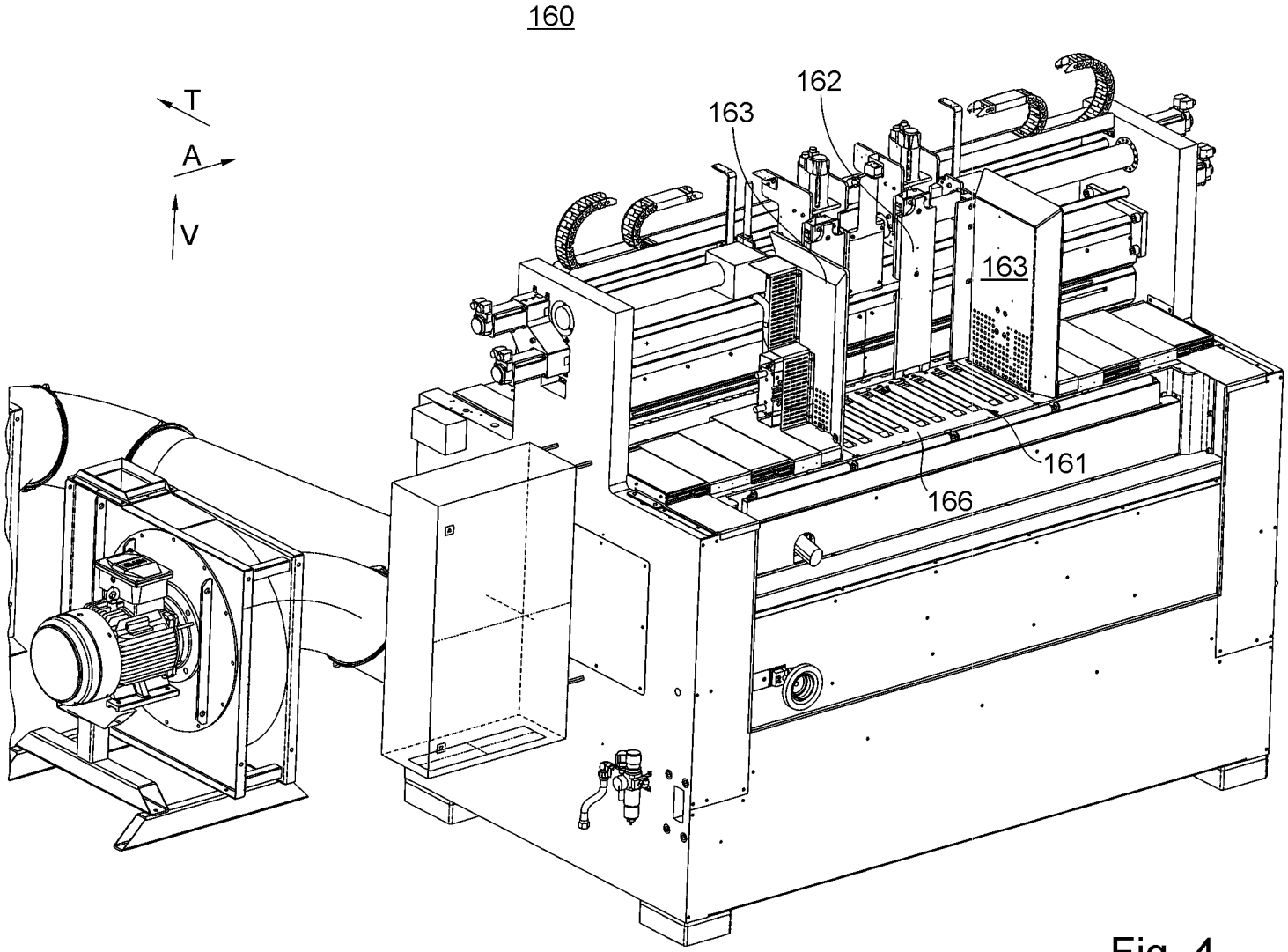
FIG. 4 a perspective diagram of the one second substrate feed device for sheets.
Figure 5:
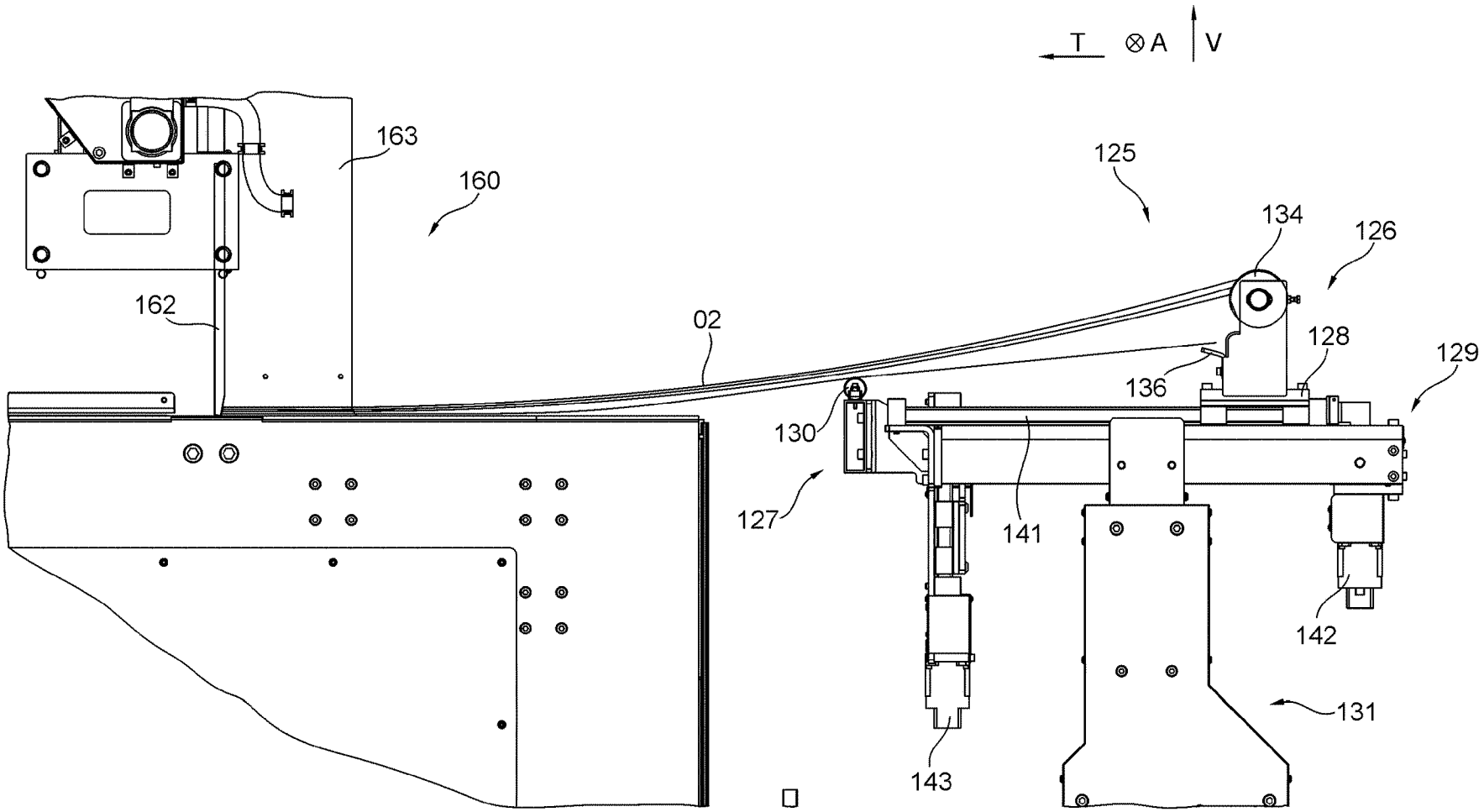
FIG. 5 a schematic side view of a substrate guiding device and a second substrate feed device.
Figure 6A:
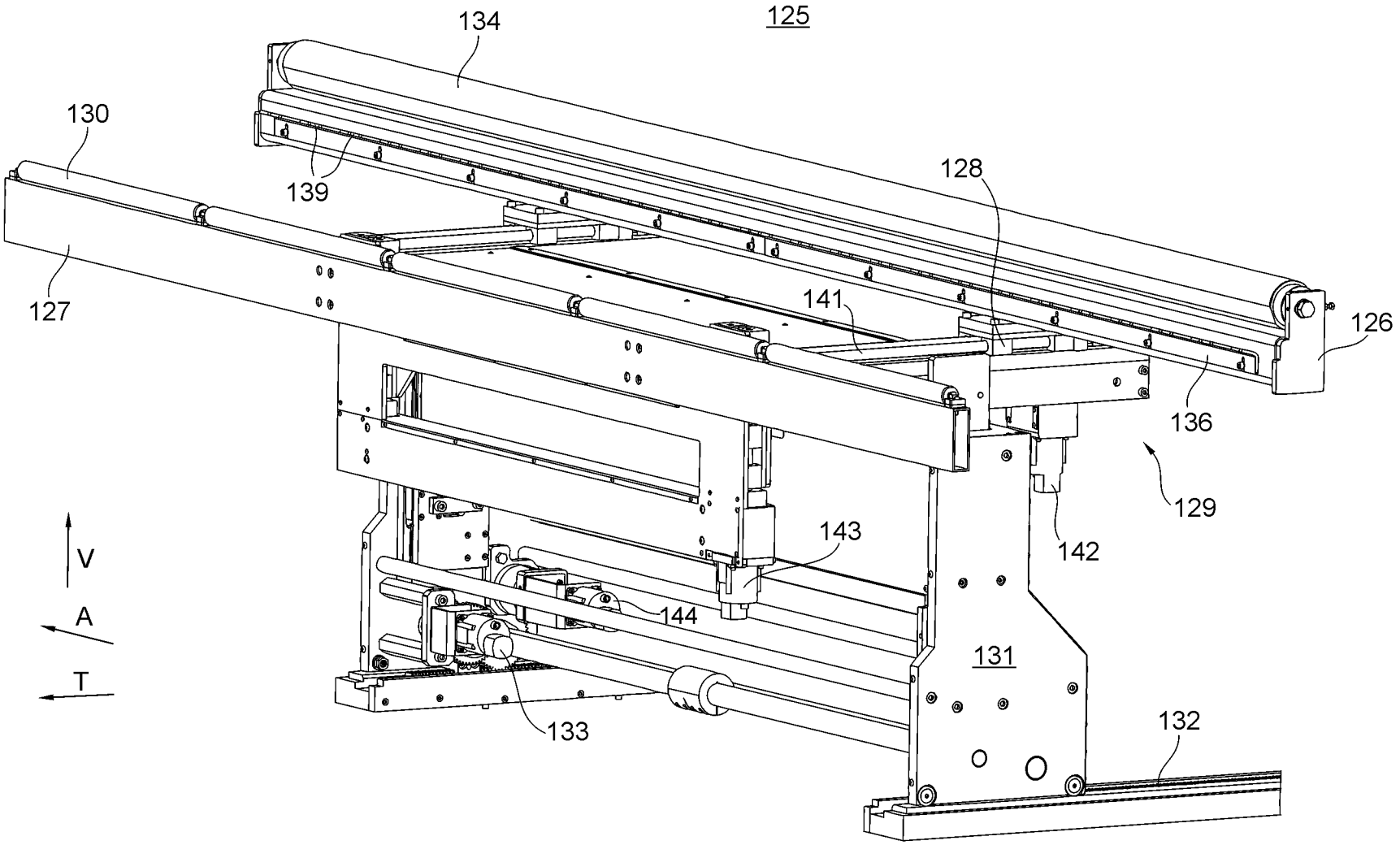
FIG. 6*a* a perspective diagram of the substrate guiding device.
Figure 6B:
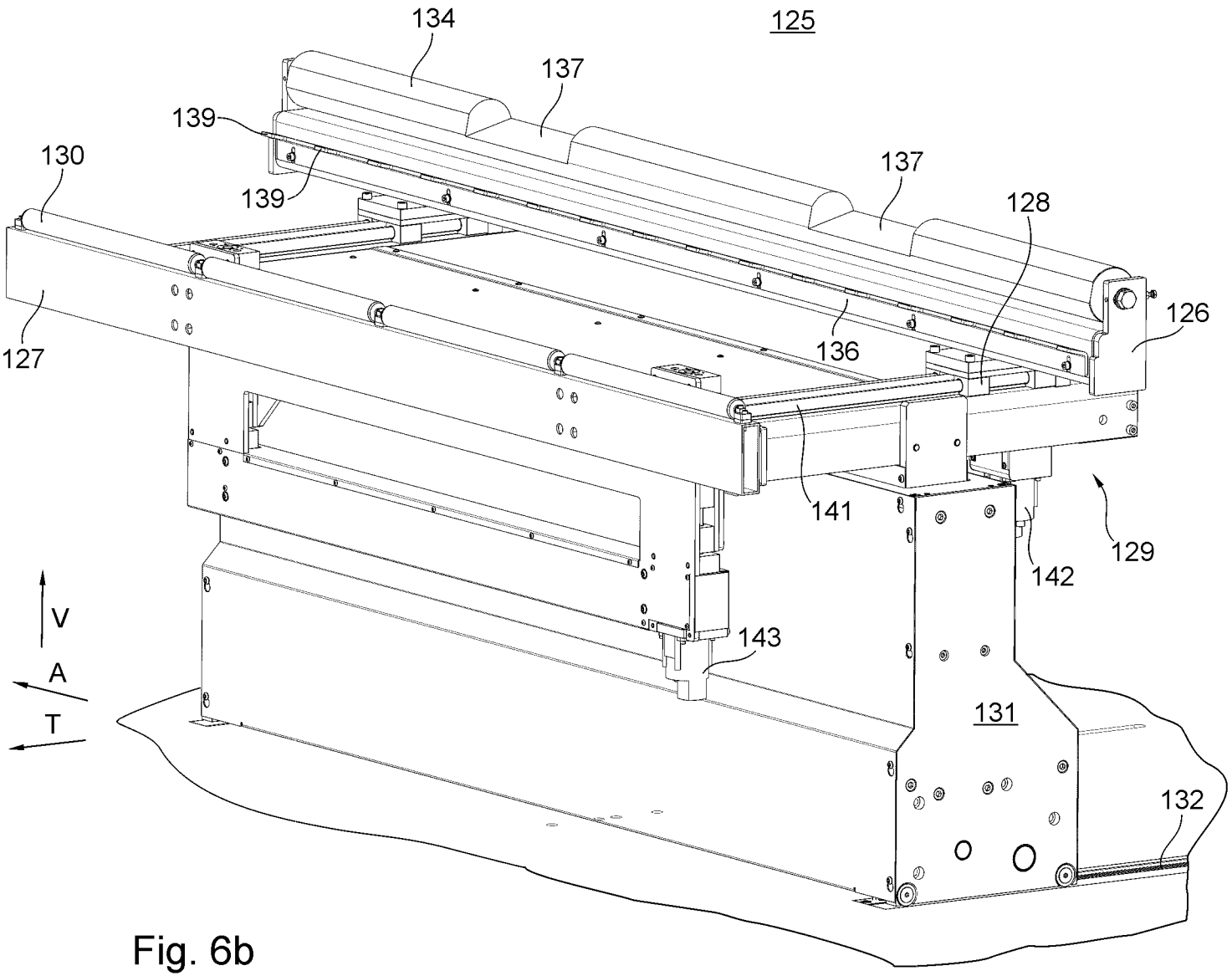
FIG. 6*b* a perspective diagram of the substrate guiding device in a preferred embodiment.

In the interest of simplicity, in the foregoing and in the following—unless otherwise explicitly distinguished and specified—the term "printing ink" is understood to refer to a liquid or at least flowable fluid colorant to be used for printing in a processing machine 01, in particular a printing press 01, and is not limited merely to the higher viscosity fluid colorants more frequently associated colloquially with the term "printing ink" for use in rotary printing presses, but in addition to these higher viscosity fluid colorants particularly also includes lower viscosity fluid colorants such as "inks", in particular inkjet inks, but also powdered fluid colorants, such as toners, for example. Thus, in the foregoing and in the following, when printing fluids and/or inks and/or printing inks are mentioned, this also includes colorless varnishes. In the foregoing and in the following, when printing fluids and/or inks and/or printing inks are mentioned, this also preferably includes, in particular, media for pretreating (known as priming or pre-coating) the printing material 02. The term coating medium may be understood as synonymous with the term printing fluid.

A processing machine 01 is preferably in the form of a printing press 01. The processing machine 01 is preferably configured as a sheet processing machine 01, i.e. as a processing machine 01 for processing sheet-format substrate 02 or sheets 02, in particular sheet-format printing material 02. The processing machine 01 is further preferably configured as a corrugated cardboard sheet processing machine 01, i.e. as a processing machine 01 for processing sheet-format substrate 02 or sheets 02 of corrugated cardboard 02, in particular sheet-format printing material 02 made of corrugated cardboard 02. More preferably, the processing machine 01 is configured as a sheet-fed printing press 01, in particular as a corrugated cardboard sheet-fed printing press 01, i.e. as a printing press 01 for coating and/or printing sheet-format substrate 02 or sheets 02 of corrugated cardboard 02, in particular sheet-format printing material 02 made of corrugated cardboard 02. For example, the printing press 01 is configured as a printing press 01 that operates according to a non-impact printing method and/or as a printing press 01 that operates according to a printing method that requires printing forms. Preferably, the printing press 01 is configured as a non-impact printing press 01, in particular as an inkjet printing press 01 and/or as a flexographic printing press 01. The printing press 01 has at least one flexographic coating unit 400; 600; 800, for example. Alternatively or additionally, the coating machine 01 preferably has at least one non-impact coating unit 400; 600; 800, in particular jet coating unit 400; 600; 800 or inkjet coating unit 400; 600; 800.

In the foregoing and in the following, wherever features are described within the context of an embodiment as a sheet processing machine 01, these features also apply to a processing machine 01 in general, in particular also to a processing machine 01 configured to process at least web-format substrate 02, that is to say a roll-fed processing machine 01 and/or web-fed processing machine 01, i.e. a processing machine 01 for processing web-format substrate

02 or at least one material web 02, in particular web-format printing material 02, in particular regardless of whether or not it comes from a roll, at least insofar as no contradictions arise as a result. In the foregoing and in the following, wherever sheets 02 are mentioned, the corresponding description also applies to substrate in general, in particular to sheets or to web-format substrate, at least insofar as no contradictions arise as a result. Preferably, a transport path for the transport of substrate 02, in particular printing material 02 and/or sheets 02, is provided. The transport path provided for the transport of printing material 02 is in particular that spatial area which the printing material 02 occupies and/or might occupy at least temporarily when it is present.

The processing machine 01 preferably comprises a transport device 100 for the substrate 02. The transport device 100 is at least one unit 100 in the form of a substrate feed device 100, also called sheet feeder 100, in particular sheet feeder unit 100, which is more preferably configured as a module 100, in particular as a sheet feeder module 100.

The processing machine 01 preferably comprises at least one unit 200; 550, in particular a conditioning unit 200; 550, in the form of a conditioning device 200; 550, which is more preferably configured as a module 200; 550, in particular as a conditioning module 200; 550. Such a conditioning device 200; 550 is configured, for example, as a pre-processing device 200 or as a post-processing device 550. The processing machine 01 preferably comprises at least one unit 200 in the form of a pre-processing device 200, in particular as a pre-processing unit 200, which is more preferably configured as a module 200, in particular as a pre-processing module 200, and which is a conditioning device 200. The processing machine 01 preferably comprises at least one unit 550, in particular a post-processing unit 550, in the form of a post-processing device 550, which is more preferably configured as a module 550, in particular as a post-processing module 550, and which is a conditioning device 550.

Preferably, the sheet-fed printing press 01 is alternatively or additionally characterized in that at least one module 100 in the form of a substrate feed device 100 is located upstream of the at least one primer module 400 and/or upstream of the at least one non-impact printing module 600 along the transport path provided for the transport of substrate 02, in particular sheet-format substrate 02, in particular printing material 02 and/or sheets 02. Preferably, the sheet-fed printing press 01 is alternatively or additionally characterized in that at least one cleaning system for substrate 02, in particular printing material 02 and/or sheets 02, is located upstream of the at least one primer module 400 and/or upstream of the at least one non-impact printing module 600 along the transport path provided for the transport of substrate 02, in particular printing material 02 and/or sheets 02. In particular, the at least one non-impact printing module comprises at least a plurality of printing assemblies 601 and/or a plurality of platforms 602, for example.

The processing machine 01 preferably comprises at least one unit 500, in particular drying unit 500, in the form of a drying device 500, which is more preferably configured as a module 500, in particular as a drying module 500. Alternatively or additionally, at least one drying assembly 501 is a component of at least one unit 100; 200; 400; 500; 550; 600; 700; 800; 900; 1000 preferably configured as a module 100; 200; 400; 500; 550; 600; 700; 800; 900; 1000, for example. In particular, the at least one drying module 500 is a specific form of processing module 500. In particular, the processing machine 01 has an after-dryer assembly 502, for example.

The processing machine 01 preferably comprises at least one unit 700 in the form of a transport device 700 or transport means 700, in particular transport unit 700, which is more preferably configured as a module 700, in particular as a transport module 700.

The processing machine 01 preferably comprises at least one unit 800 in the form of a varnishing system 800, also called a varnishing mechanism 800, in particular varnishing unit 800, which is further preferably configured as a module 800, in particular as a varnishing module 800. The at least one primer module 800 is, in particular, a specific form of processing module 800.

The processing machine 01 preferably comprises at least one unit 900 in the form of a shaping system 900 and/or die-cutting system 900, in particular shaping unit 900 and/or die-cutting unit 900, which is more preferably configured as a module 900, in particular as a shaping module 900 and/or die-cutting module 900. The at least one shaping module 900 and/or die-cutting module 900 is, in particular, a specific form of processing module 900.

The processing machine 01 preferably comprises at least one unit 1000 in the form of a substrate delivery system 1000, also called a sheet delivery 1000, in particular delivery unit 1000, which more preferably is configured as a module 1000, in particular as a delivery module 1000.

Unless an explicit distinction is made, the term sheet-format substrate 02, in particular printing material 02, specifically sheet 02, generally includes any flat substrate 02 in the form of sections, i.e. including substrates 02 in tabular form or panel form, i.e. including boards or panels. The sheet-format substrate 02 or sheet 02 thus defined is made, for example, of paper or paperboard, i.e. as sheets of paper or paperboard, or as sheets 02, boards, or optionally panels made of plastic, cardboard, glass, or metal. The substrate 02 is more preferably corrugated cardboard 02, in particular corrugated cardboard sheets 02. The thickness of a sheet 02 is preferably understood as the dimension orthogonally to the largest surface area of the sheet 02. This largest surface area is also referred to as the main surface area. The thickness of the sheets 02 is, for example, at least 0.1 mm, more preferably at least 0.3 mm, and even more preferably at least 0.5 mm. For sheets of corrugated cardboard 02, in particular, significantly greater thicknesses are also common, for example at least 4 mm or even 10 mm or more. Corrugated cardboard sheets 02 are relatively stable and therefore are not very flexible. Appropriate adjustments to the processing machine 01 therefore facilitate the processing of very thick sheets 02.

The processing machine 01 preferably comprises a plurality of units 100; 200; 400; 500; 550; 600; 700; 800; 900; 1000. Each unit 100; 200; 400; 500; 550; 600; 700; 800; 900; 1000 is preferably understood as a group of devices that function in cooperation, in particular to carry out a preferably self-contained processing operation of substrate 02, in particular printing material 02 and/or sheets 02. For example, at least two and preferably at least three, and more preferably all of the units 100; 200; 400; 500; 550; 600; 700; 800; 900; 1000 are configured as modules 100; 200; 400; 500; 550; 600; 700; 800; 900; 1000 or are at least each associated with such a module. A module 100; 200; 400; 500; 550; 600; 700; 800; 900; 1000 is understood, in particular, as a respective unit 100; 200; 400; 500; 550; 600; 700; 800; 900; 1000 or as a structure composed of a plurality of units 100; 200; 400; 500; 550; 600; 700; 800; 900; 1000, which preferably comprises at least one transport means and/or at least one open-loop controllable and/or closed-loop controllable drive dedicated uniquely to it, and/or at least one section of a transport path provided for the transport of substrate 02, in particular printing material 02 and/or sheets 02, which section begins and/or ends at a first standard height which is the same for a plurality of modules 100; 200; 400; 500; 550; 600; 700; 800; 900; 1000, without deviation or with a maximum deviation of 5 cm, preferably a maximum of 1 cm and more preferably a maximum of 2 mm, and/or is configured as an independently functioning module 100; 200; 400; 500; 550; 600; 700; 800; 900; 1000 and/or as a machine unit or functional assembly which is produced and/or installed as a separate entity.

The direction of transport T intended, in particular, for the transport of sheets 02 is a direction T which is preferably oriented at least substantially and more preferably entirely horizontally and/or which preferably leads from a first unit 100; 200; 400; 500; 550; 600; 700; 800; 900 of the processing machine 01 to a last unit 200; 400; 500; 550; 600; 700; 800; 900; 1000 of the processing machine 01, in particular from a sheet feeder unit 100 or a transport device 100 to a delivery unit 1000 or a substrate delivery system 1000, and/or which preferably leads in a direction in which the sheets 02 are transported, apart from vertical movements or vertical components of movements, in particular from a first point of contact with a unit 200; 400; 500; 550; 600; 700; 800; 900; 1000 of the processing machine 01 located downstream of the transport device 100, or a first point of contact with the processing machine 01, to a last point of contact with the processing machine 01.

The working width of the processing machine 01 and/or of the at least one coating unit 400; 600; 800 is preferably a dimension which extends preferably orthogonally to the intended transport path of sheets 02 through the at least one coating unit 400; 600; 800, more preferably in a transverse direction A. The transverse direction A is preferably a horizontal direction A. The transverse direction A is oriented orthogonally to the intended direction of transport T of sheets 02 and/or orthogonally to the intended transport path of sheets 02 through the at least one coating unit 400; 600; 800. The working width of the processing machine 01 preferably corresponds to the maximum width a sheet 02 may have in order to still be processable with the processing machine 01, i.e. in particular a maximum sheet width that can be processed with the printing press 01. In this context, the width of a sheet 02 is understood in particular as its dimension in the transverse direction A. This is preferably independent of whether this width of the sheet 02 is greater than or less than a horizontal dimension of the sheet 02 orthogonally thereto, which more preferably represents the length of said sheet 02. The substrate 02, in particular the sheet 02, preferably has a length, in particular a length of the at least one substrate 02, of between 300 mm and 1,500 mm, more preferably between 700 mm and 1,300 mm. The working width of the processing machine 01 is preferably equal to the working width of the at least one coating unit 400; 600; 800, in particular printing unit 600. The working width of the sheet processing machine 01 is preferably at least 100 cm, more preferably at least 150 cm, even more preferably at least 160 cm, even more preferably at least 200 cm, and more preferably still at least 250 cm.

In the foregoing and in the following, a vertical direction V refers to a direction which is preferably orthogonal to the plane spanned by the transverse direction A and direction of transport T. The vertical direction V together with the transverse direction A and the direction of transport T preferably form a Cartesian system of coordinates.

In the following, various embodiments and/or possible configurations of the transport device 100 are described. Various combinations of individual configurations are possible. The transport device 100 is preferably configured as independent of other units 200; 400; 500; 550; 600; 700; 800; 900; 1000, provided no contradictions arise as a result. Piles 105 are fed to the substrate feed device 100 manually and/or by means of an automated system, for example, in particular in the form of piles 105 preferably arranged on carrier units 113. Such carrier units 113 are pallets 113, for example. Piles 105 that are or have been fed as such to the transport device 100 are also referred to as feeder piles 105, for example. The carrier units 113 or pallets 113 preferably have correspondingly oriented grooves, for example for the engagement of pile carriers, in particular for removing sheets 02 and/or piles 105 from the carrier units 113 or pallets 113.

The transport device 100 comprises, for example, at least one first substrate feed device 101, at least one substrate guiding device 125, and at least one second substrate feed device 160. The at least one first substrate feed device 101 is preferably used to singulate sheets 02 of a pile 105 or partial pile 106 and more preferably to feed said singulated sheets to one or more units 200; 400; 500; 550; 600; 700; 800; 900 downstream. The at least one first substrate feed device 101 has at least one pile turning device 102 or sheet turning device, for example. The pile turning device 102 is preferably used to turn a pile 105 or partial pile 106, which comprises at least a plurality of sheets 02, as a whole. Turning the sheets 02 is useful, for example, when two opposing main surface areas of the sheets 02 are different from one another and a specific one of these main surface areas is to be subsequently processed. This is the case regardless of whether the sheets 02 are turned individually or whether the pile 105 is turned as a whole or whether partial piles 106 are turned. This applies, for example, if the sheets 02 have already been processed before they are combined to form the pile 105 and/or if the sheets 02 have inherently distinguishable main surface areas. In the case of corrugated cardboard sheets 02, such distinguishable main surface areas result from the production process, for example.

A pile holding area 103 is an area 103, in particular a spatial area 103, in which the pile 105 that will be subdivided for the subsequent processing of its sheets 02 is located, at least temporarily, at least during operation of the processing machine 01. The pile holding area 103 preferably encompasses the entire spatial area provided for the positioning of such a pile 105, in particular regardless of whether the pile 105 takes up less space than is available, for example because its sheets 02 have already been partially singulated or have a format which is smaller than the maximum possible format. This pile 105 is preferably the feeder pile 105. The at least one pile turning device 102 is located upstream of the pile holding area 103, for example, with respect to a transport path provided for the sheets 02. Alternatively or additionally, at least one pile turning device 102 is located downstream of the pile holding area 103 with respect to the transport path provided for sheets 02. In that case, the pile turning device 102 is preferably configured as a partial pile turning device 102. A partial pile separator 104 is provided, for example, which serves to separate an upper partial pile 106, in particular, from the pile 105 located in the pile holding area 103.

Independently of whether a pile turning device 102 or a partial pile turning device 102 is provided, the at least one first transport device 101 preferably has at least one singulating device 109 or sheet singulating device 109. Optionally, a plurality of singulating devices 109 may be provided, in particular spaced from one another and/or one behind the other with respect to the direction of transport T.

The at least one singulating device 109 or sheet singulating device 109 preferably at least partially singulates the sheets 02 of the pile 105 or partial pile 106. In at least one embodiment, the at least one singulating device 109 or sheet singulating device 109 singulates the sheets 02 of the pile 105 or partial pile 106 from the bottom, and in at least one other embodiment, it singulates the sheets from the top.

The processing machine 01 preferably in the form of a sheet-fed printing press 01 and in particular the transport device 100 preferably comprises at least one second substrate feed device 160 for at least one holding pile 169 of sheets 02. The substrate feed device 160 is preferably located downstream of the pile holding area 103 with respect to the transport path provided for the transport of substrate 02, in particular printing material 02 and/or sheets 02. Two holding piles 169 are provided, for example, one of which is configured as an infeed pile 169 and one as a buffer pile. Sheets 02 taken from a first pile 105, configured, for example, as a feeder pile 105, can preferably be fed, in particular from above, by means of the transport device 100 to the at least one second substrate feed device 160 and in particular to the at least one holding pile 169. The at least one second substrate feed device 160 preferably includes at least one singulating device 165 which acts from below and which is configured to remove the bottommost sheet 02 individually in each case from a holding pile 169 and in particular from an infeed pile 169.

The at least one second substrate feed device 160 preferably has at least one forward stop 162, which is preferably in the form of a forward wall 162. The at least one second substrate feed device 160 preferably has at least one lateral stop 163, which is preferably in the form of a lateral wall 163. More preferably, lateral stops 163 are arranged on both sides of the at least one second substrate feed device 160 with respect to the transverse direction A.

The at least one singulating device 165 preferably has at least one, in particular primary acceleration means 161, in particular for accelerating the bottommost sheet 02 of the at least one holding pile 169 or infeed pile 169 in each case, more preferably in the direction of transport T. The at least one primary acceleration means 161 is preferably arranged below the at least one holding pile 169. The at least one primary acceleration means 161 is in the form, for example, of at least one transport roller 161 and/or at least one conveyor belt 161 and/or at least one suction transport means 161, in particular suction belt 161 and/or suction box belt 161 and/or roller suction system 161 and/or suction gripper 161 and/or suction roller 161. A plurality of primary acceleration means 161 are provided, for example, in particular in the form of a plurality of transport rollers 161 and/or a plurality of conveyor belts 161 and/or a plurality of suction transport means 161, which can preferably be driven by a common primary drive M101. For example, a plurality of primary acceleration means 161 are arranged one behind the other with respect to the direction of transport T. Alternatively or additionally, the at least one primary acceleration means 161 has at least two, more preferably at least three, even more preferably at least five, and more preferably still at least seven transport surfaces, which are separated from one another with respect to the transverse direction A by gaps.

In a holding position, the bottommost sheet 02 of the infeed pile 169 rests in each case on the spacer 166 without touching the primary acceleration means 161. When the at least one spacer 166 is then lowered and/or the at least one primary acceleration means 161 is raised, the respective bottommost sheet 02 of the infeed pile 169 comes into contact with the corresponding at least one primary acceleration means 161. Appropriate actuation of the at least one primary acceleration means 161 causes said sheet 02 to move forward in the direction of transport T.

Preferably, the sheet-fed printing press 01 is alternatively or additionally characterized in that a plurality of spacers 166, for example at least one first spacer 166 and at least one second spacer 166, are mounted such that they are movable independently of one another at least with respect to the vertical direction V.

The at least one primary acceleration means 161, alone or more preferably in cooperation with at least one additional, in particular secondary acceleration means 171, preferably serves to accelerate exactly one sheet 02 at a time, which has preferably already been aligned with respect to the direction of transport T and/or the transverse direction A. At least one secondary acceleration means 171 is preferably located downstream of the at least one primary acceleration means 161 along a transport path provided for the transport of sheets 02. This acceleration is carried out, for example, from a temporary stationary state and/or to a processing speed and/or coating speed and/or printing speed, at which at least one sheet 02 is transported, at this and/or at a later time, through at least one additional unit 200; 400; 500; 550; 600; 700; 800; 900; 1000 or module 200; 400; 500; 550; 600; 700; 800; 900; 1000, where it is processed.

At least one outgoing transport means 171 of the transport device 100 is preferably located downstream of the at least one primary acceleration means 161 with respect to the direction of transport T. This outgoing transport means is configured, for example, as at least one transport roller 171 or at least one pair of transport rollers 171 or as at least one suction transport means 171. This at least one outgoing transport means 171 is likewise an acceleration means 171, for example, in particular the at least one secondary acceleration means 171. The at least one secondary acceleration means 171 is preferably in the form of a suction transport means 171. For example, the at least one secondary acceleration means 171 has at least two, preferably at least three, more preferably at least five and more preferably still at least seven transport surfaces separated from one another by gaps with respect to the transverse direction A, which are preferably driven jointly by the at least one drive M102.

The at least one forward stop 162 is preferably used to align the sheets 02 of the infeed pile 169. For example, the at least one forward stop 162 is at least intermittently positioned such that it acts at least on the second sheet 02 from the bottom of the infeed pile 169 and/or is out of contact with the bottommost sheet 02 of the infeed pile 169 in each case. Alignment occurs, for example, when the sheet 02 lying on top of the bottommost sheet 02 is pressed against the at least one forward stop 162 by the transport of the bottommost sheet 02 and is thereby aligned before said top sheet itself comes into contact with the at least one, in particular primary acceleration means 161, which at that time is more preferably stationary. The at least one forward stop 162 is preferably configured with a width that is decreased by at least 10% in the region of the at least two bottommost sheets 02, more preferably for the three bottommost sheets 02. In particular, the width decreases steadily down to the bottommost sheet 02. In the foregoing and in the following, the width of the at least one forward stop 162 refers to the dimension of the at least one forward stop 162 in the direction of transport T. The at least two bottommost sheets 02, more preferably the at least three bottommost sheets 02, are accordingly arranged partially offset from the at least one holding pile 169 in the direction of transport T.

The position of the at least one forward stop 162 in the vertical direction V is preferably adjustable. The height of the at least one forward stop 162 is preferably adjustable, allowing it to be adapted to different thicknesses of sheets 02. The sheet feeder unit 100 preferably has at least one forward stop 162, which is located between the at least one primary acceleration means 161 and the at least one secondary acceleration means 171 along the transport path provided for the transport of substrate 02, in particular printing material 02 and/or sheets 02.

Adjustment to different lengths of sheets 02 to be processed is preferably possible. The length of a sheet 02 is understood here in particular as its dimension in the direction of transport T and/or its horizontal dimension oriented orthogonally to the transverse direction A. Adjustment is preferably possible in that the at least one forward stop 162 is and/or can be moved with respect to the direction of transport T and, in particular, is mounted such that it is and/or can be adjusted to the length of the sheets 02.

The at least one buffer pile serves in particular to ensure a continuous supply of sheets 02. Corrugated cardboard sheets 02 in particular are relatively thick, i.e. they have relatively large dimensions in the vertical direction V. This enables piles 105 of corrugated cardboard sheets 02 to be processed very quickly by singulation. For an uninterrupted supply of sheets 02 to the processing machine 01, a buffering of sheets 02 which can be processed at least partially while the feeder pile 105 is being replaced or renewed is therefore advantageous.

Sheets 02 are preferably fed to the at least one second substrate feed device 160 from above. More preferably, these sheets 02 are fed to the at least one second substrate feed device 160 fully singulated or at least partially singulated. The sheets 02 are preferably fed to the at least one second substrate feed device 160 by first being removed from a feeder pile 105.

This singulation of sheets before they are fed into the at least one second substrate feed device 160 and to the at least one substrate guiding device 125 is carried out as described, for example, from below, in particular by means of a lower transport means 111 on which the sheets 02, lying flat in the form of a pile 105 or preferably a partial pile 106, run at least partially up against the barrier 112 and are thereby singulated or partially singulated, i.e. imbricated, depending on the setting of the barrier 112.

The transport device 100 for a sheet-format substrate 02 has at least one first substrate feed device 101 and at least one second substrate feed device 160, which comprises the at least one forward stop 162 and the at least one singulating device 165. At least one substrate guiding device 125 is located between the at least one first substrate feed device 101 and the at least one second substrate feed device 160. The at least one substrate guiding device 125 preferably has at least one directing element 126 and/or one supporting element 127. The at least one directing element 126 and/or the at least one supporting element are preferably movable independently of one another.

The at least one directing element 126 is preferably mounted such that it is movable and/or moved. The at least one directing element 127 is preferably mounted such that it is movable and/or moved in two different directions independently of one another. The first of the two different directions preferably has a greater component in the vertical direction, in particular greater than the horizontal component of the direction, and the second of the two different directions has a greater horizontal component, in particular greater than the vertical component of the direction. The at least one directing element 126 is mounted operatively connected to at least one first linear guide 141 and at least one second linear guide. Preferably, the at least one directing element 126 is mounted such that it is movable on the at least one first linear guide 141 and the at least one second linear guide independently of one another. Operatively connected is therefore understood, in particular, to mean that the at least one directing element 126 and/or the at least one supporting element 127 is guided, for example indirectly, on the guidance path of the linear guide. The guidance path limits the area in which the guide element can be and/or is moved back and forth for the purpose of adjustment, for example. The guidance path is preferably disposed parallel to one of the two different directions. In particular, the at least one directing element 126 is mounted such that it is guided on and/or operatively connected to two linear guides. In this context, operatively connected includes, in particular, cases in which additional components are arranged between the guided element, for example directing element 126 and/or supporting element 127. In particular, a plurality of elements, such as the at least one supporting element 127 and/or the at least one directing element 126, can also be arranged on one linear guide.

Preferably, the at least one first linear guide 141 has a first guidance path and the at least one second linear guide has a second guidance path. The first guidance path and the second guidance path are arranged spanning an area. The area is disposed parallel to the plane which is spanned by the direction of transport T of the sheet-format substrate 02 by the transport device 100 and the vertical direction V. The at least one directing element 126 is mounted such that it can be moved to any point in the area by means of the linear guides.

The at least one directing element 126 comprises at least one guide element 128 and is mounted for displacement at least in one direction which points toward the at least one first substrate feed device 101, and/or at least in a second direction which points toward the at least one second substrate feed device 160, and/or in the direction of transport T. The at least one guide element 128 comprises, for example, a guide rail and a movable element on which the at least one directing element 126 is arranged. Preferably, the at least one guide element 128 is mounted for guidance on the at least one first linear guide 141. The two elements 126; 127 are preferably mounted such that they are movable independently of one another.

The at least one supporting element 127 is mounted operatively connected to at least one third linear guide or with the at least one first linear guide 141, and the at least one supporting element 127 is mounted operatively connected to at least one fourth linear guide 132 or with the at least one second linear guide.

The at least two linear guides of the at least one supporting element 127 define a third guidance path and a fourth guidance path. The third guidance path and the fourth guidance path are arranged spanning an area. The area is disposed parallel to the plane which is spanned by the direction of transport T and the vertical direction V, and the at least one supporting element 127 is mounted such that it can be moved to any point in the area by means of the linear guides.

The at least one supporting element 127 and the at least one directing element 126 are preferably mounted for horizontal and vertical movement. The two elements 126; 127 may be mounted on one common linear guide, for example, or may be mounted on linear guides that are separated from one another. In that case, the at least one supporting element 127 is mounted in particular on a third linear guide and/or a fourth linear guide 132.

The at least one supporting element 127 is mounted for displacement at least in one direction, at least a part of which is a vertical direction V. Preferably, the at least one supporting element 127 is mounted for displacement on a guide rail, in particular on one of the linear guides, by means of a drive 143, for example, in particular an electric motor 143. The at least one supporting element 127 preferably has at least one, more preferably at least three, more preferably at least five preferably rotatably mounted support rollers 130 over its working width. In a further embodiment, the at least one supporting element 127 preferably has at least one brush in place of or in addition to the at least one support roller 130 over its working width in the transverse direction A. In the foregoing and in the following, a part of a direction refers in particular to a component of a direction.

At least one superstructure 129 comprises the at least one directing element 126 and the at least one supporting element 127. The at least one superstructure 129 is mounted for displacement by means of a drive 133, for example, in particular an electric motor 133, at least in one direction, at least a part of which is a vertical direction V. An at least partially vertical movement of this type is configured, in particular, such that the height of the at least one superstructure 129 is adjusted. In particular, by displacing the at least one superstructure 129, the at least one supporting element 127 and the at least one directing element 126 are mounted such that the position of the at least one supporting element 127 and the position of the at least one directing element 126 are likewise displaceable, together with the at least one superstructure 129, in a direction at least a part of which is a vertical direction V. More particularly, with the displacement of the at least one superstructure 129 in the vertical direction V, the at least one supporting element 127 and the at least one directing element 126 is likewise displaceable in the vertical direction V, more preferably in terms of height. In particular, the at least one supporting element 127 and the at least one directing element 126 are preferably mounted for displacement parallel to the direction of displacement of the superstructure 129. In addition, the at least one directing element 126 and the at least one supporting element 127 are mounted such that they are displaceable and/or displaced independently of the at least one superstructure 129.

At least one frame 131 comprises the at least one superstructure 129. The at least one frame 131 is mounted for displacement at least in a direction which points toward the at least one first substrate feed device 101, and/or at least in a direction which points toward the at least one second substrate feed device 160, and/or at least in the direction of transport T. The at least one frame 131 is preferably mounted on a guide rail 132, preferably on the at least one fourth linear guide 132. The frame 131 is preferably mounted for displacement by means of at least one drive 144, in particular at least one electric motor 144. The at least one directing element 126 is mounted for displacement directly or indirectly via displacement of the at least one frame 131 by a distance of at least 300 mm and a maximum of 1,500 mm, more preferably by a distance of at least 700 mm and a maximum of 1,300 mm from the at least one forward stop 162. In particular, the at least one frame 131 comprises the at least one superstructure 129, the at least one supporting element 127, and the at least one directing element 126. When the at least one frame 131 is displaced, the at least one superstructure 129, the at least one supporting element 127, and the at least one directing element 126 are preferably likewise displaced parallel to the direction of displacement of the frame 131. The at least one superstructure 129, the at least one directing element 126, and the at least one supporting element 127 are preferably mounted such that they are displaceable independently of the at least one frame 131.

In a preferred embodiment, the at least one substrate guiding device 125 is equipped with at least one braking element. Such a braking element is arranged such that the frame 131, the superstructure 129, the at least one supporting element, and/or the at least one directing element 126 are situated and remain in position. Such a braking element is necessary, in particular, for processing sheets with large dimensions, for example 1.7 by 2.3 meters.

The at least one directing element 126 and the at least one supporting element 127 and the at least one superstructure 129 are each mounted for displacement relative to the at least one frame 131, for example by means of a drive 142, in particular an electric motor 142.

The at least one substrate guiding device 125 is mounted for displacement at least from a first position associated with a first length of the at least one substrate 02 to a second position associated with a second length of the at least one substrate 02. The at least one substrate guiding device 125 is mounted for displacement on the basis of a data set stored in the memory of a storage device.

The at least one directing element 126 and/or the at least one supporting element 127 and/or the at least one superstructure 129 and/or the at least one frame 131 is mounted for displacement at least from a first position associated with one substrate length to a different, second position associated with a second substrate length, for example on the basis of the data set stored in the memory of a storage device. The at least one supporting element 127 is preferably mounted such that it can be displaced directly or indirectly by the displacement of the at least one superstructure by a maximum of 1 meter, more preferably a maximum of 50 cm. In particular, in the first position the at least one directing element 126 and/or the at least one supporting element 127 and/or the at least one superstructure 129 and/or the at least one frame 131 are at a different distance from the at least one second substrate feed device 160 as compared with the distance in the second position.

The at least one frame 131 or the at least one directing element 126 or the at least one supporting element 127 or the at least one superstructure 129 is mounted for displacement, preferably pneumatically and/or hydraulically and/or electrically, by at least one drive 133; 142; 143; 144, more preferably by at least one electric motor 133; 142; 143; 144. Preferably, the at least one frame 131 and the at least one directing element 126 and the at least one supporting element 127 and the at least one superstructure 129 are mounted such that they are displaceable independently of one another, each by the at least one drive 133; 142; 143; 144, in particular by the at least one electric motor 133; 142; 143; 144.

The at least one directing element 126 is mounted such that it can be placed immediately adjacent to the at least one second substrate feed device 160. In a preferred embodiment, the at least one directing element 126 is arranged protruding, in particular, into the at least one second substrate feed device 160. For this purpose, the at least one second substrate feed device 160 preferably has a feature, in particular a recess, with the at least one substrate guiding device 125 being mounted such that it can be placed protruding into said recess.

The at least one directing element 126 has at least one directing bar 134 and at least one bearing rail 136. At least over parts of its lateral surface, the at least one directing bar 134 has at least one surface area which lies in one plane. The at least one directing bar 134 is mounted for rotational displacement by means of a drive, for example. In the case of a cylindrical extension and/or in the case of a differently shaped extension, the at least one directing bar 134 has at least one surface area, in particular a partial area of the surface, which lies in one plane. Preferably, the at least one directing bar 134 extends cylindrically and has on its lateral surface a surface which makes up a maximum of 50% of the lateral surface, for example, and which lies in one plane.

The working width of the at least one directing bar 134 preferably corresponds to the working width of the sheet processing machine 01. The at least one directing bar 134 is flattened at least over parts of the working width and preferably over the entire working width. The angle of inclination of the flattened lateral surface is displaceable by means of the rotatably displaceable mounting. The at least one directing bar 134 is preferably mounted such that it can be adjusted to the length of the at least one substrate 02. The at least one directing bar 134 is preferably positioned such that the distance from the forward wall to the edge of the flattened surface of the at least one directing bar 134 is at least just greater than the length of the at least one bottommost sheet 02 of the at least one holding pile 169. The at least one directing bar 134 with the at least partially flattened lateral surface is preferably arranged such that at least a partial singulation, in particular of the at least one bottommost sheet 02, of the at least one holding pile 169 takes place. More preferably, a partial singulation of the at least two sheets 02, in particular of at least the bottommost three sheets 02, takes place. For example and preferably, singulation is carried out in cooperation with the decreased width of the at least one forward stop 162 and/or due to the weight of the at least one holding pile 169 with the deflection of the at least one bottommost sheet 02. Due to the decreased width of the at least one forward stop 162, the at least one bottommost sheet 02, in particular at least the bottommost three sheets 02 of the at least one holding pile 169, are arranged offset from one another in the direction of transport T. In particular, the at least one bottommost sheet 02, in particular the at least three bottommost sheets 02, slides and/or drops from the at least one directing bar 134 via the flattened surface area of the at least one directing bar 134 onto at least one bearing rail 136.

In an alternative preferred embodiment, the at least one directing bar 134 has at least one notch 137, preferably at least two notches 137, over its working width in transverse direction A. In one embodiment, at least one pushing device 138, preferably two pushing devices 138, of the at least one first substrate feed device 101 is/are arranged protruding into the at least one notch 137. The at least one pushing device 138 is preferably arranged opposite the at least one forward wall 162.

The at least one bearing rail 136, in particular also called a finger rail 136, has at least one bearing element 139, preferably at least six bearing elements 139, more preferably at least ten bearing elements 139, in the transverse direction A. The at least one bearing element 139 is arranged protruding a maximum of 10 cm, for example, more preferably a maximum of 5 cm, away from the at least one bearing rail 136, at least in the direction of transport T and/or at least in a direction that points toward the at least one second substrate feed device 160. The at least one bearing element 139 has a maximum dimension of 20%, more preferably a maximum of 10%, of the working width of the at least one bearing rail 136 in the transverse direction A. Preferably, the working width of the at least one bearing rail 136 is equal to the working width of the sheet processing machine 01.

With at least one first substrate feed device 101 and at least one second substrate feed device 160, which comprises at least one forward stop 162 and at least one singulating device 165, the at least one sheet-format substrate 02 is transported downstream of the at least one first substrate feed device 101 and upstream of the at least one second substrate feed device 160 via at least one substrate guiding device 125. The at least one substrate guiding device 125 has at least one directing element 127. The at least one directing element 127 is moved in two different directions independently of one another.

In particular, the at least one substrate guiding device 125 is adjusted by means of at least one directing element 127, which can be displaced in two different directions at least independently of one another, according to at least one substrate format and/or at least one substrate property. For this purpose, the at least one directing element 126 is preferably displaced on at least one first linear guide 141 and at least one second linear guide. The at least one second linear guide is arranged associated with the at least one superstructure 129, for example. The at least one directing element 127 is moved from a first position, which is adapted to at least one first substrate format and/or at least one substrate property, to a second position, which is adapted to at least one second substrate format and/or at least one substrate property. The substrate format refers to the substrate length and/or the substrate thickness, for example. A substrate property includes the material-based deflection and/or flexibility of the substrate, for example. The at least one substrate guiding device 125 is adjusted to different substrate formats and/or substrate properties by means of at least one supporting element 127, which can be displaced in two different directions at least independently of one another. The at least one substrate 02 is supported by the at least one supporting element 127 of the at least one substrate guiding device 125 to prevent its deflection and/or bending and/or height adjustment for feeding to the at least one second substrate feed device 160. In particular, the at least one supporting element 127 is displaced at least on at least one third linear guide or the at least one first linear guide 141 and is preferably additionally displaced on at least one fourth linear guide 132 or the at least one second linear guide.

The at least one substrate 02 is guided by at least one directing element 126 of the at least one substrate guiding device 125, adjusted to the length of the least one substrate 02, to the at least one second substrate feed device 160. In particular, the at least one directing element 126 is positioned adjusted according to the length of the substrate 02. The at least one directing element 126 establishes the distance to the second substrate feed device 160 and conveys the substrate 02 to the second substrate feed device 160 such that the distance is adjusted to the substrate length. In particular, the at least one directing element 126 conveys the at least one substrate 02 and/or the sheet 02, precisely aligned in terms of length, to the at least one second substrate feed device 160.

Supported in this context refers in particular to the supporting of the at least one substrate 02, in particular against deflection of the at least one substrate 02 and/or against bending of the at least one substrate 02, and a height adjustment of the one substrate 02 for feeding to the at least one second substrate feed device 160. Directed here refers in particular to the length adjustment to the length of the at least one substrate 02 to the at least one second substrate feed device 160.

The at least one substrate 02 is transported via at least one superstructure 129 which comprises the at least one directing element 126 and the at least one supporting element 127. The at least one substrate 02 is transported via at least one frame 131 which comprises the at least one superstructure 129.

The at least one substrate guiding device 125 is adjusted to the length of the at least one substrate 02 and/or to the deflection of the at least one substrate 02 and/or to the thickness of the at least one substrate 02. In one preferred embodiment, the substrate guiding device 125 is adjusted to the length of the at least one substrate 02 and/or to the deflection of the at least one substrate 02 and/or to the thickness of the at least one substrate 02 by means of the frame 131, the superstructure 129, the at least one supporting element 127, and the at least one directing element 126. In a further preferred embodiment, the at least one substrate guiding device 125 has a different arrangement of elements which are adjustably mounted. In particular, more or fewer adjustable elements may be provided in a different arrangement.

The at least one directing element 126 and the at least one supporting element 127 and the at least one superstructure 129 and the at least one frame 131 are adjusted to the length of the at least one substrate 02 and/or the deflection of the at least one substrate 02 and/or according to the thickness of the at least one substrate 02. In the foregoing and in the following, the orthogonal component of the offset of the deformed position to the non-deformed position is referred to as deflection. The deflection of the at least one substrate 02 is preferably a maximum of 20%, more preferably a maximum of 10%. More particularly, the at least one substrate 02 is deflected at most to such an extent that bending of the at least one substrate 02 is avoided.

The rough adjustment of the setting to the length of the at least one substrate 02 is accomplished by the displacement of the at least one frame 131 in a direction that points toward the at least one second substrate feed device 160 or in a direction that points toward the at least one first substrate feed device 101, and/or in the direction of transport T. The fine adjustment of the setting to the length of the at least one substrate 02 is accomplished by the displacement of the at least one directing element 126 in a direction that points toward the at least one second substrate feed device 160 or in a direction that points toward the at least one first substrate feed device 101, and/or in the direction of transport T. The at least one directing element 126 is preferably arranged displaced parallel to the at least one frame 131.

The rough adjustment of the setting to the thickness of the at least one substrate 02 and to the deflection of the at least one substrate 02 is accomplished by the displacement of the at least one superstructure 129 at least in one direction, at least part of which is a vertical direction V. The fine adjustment of the setting according to the thickness of the at least one substrate 02 and to the deflection of the at least one substrate 02 is accomplished by the displacement of the supporting element 127 at least in one direction, a part of which is a vertical direction V. Additionally or alternatively, a height adjustment is carried out based on the deflection of the substrate 02 to ensure that the deflection is a maximum of 20%, more preferably a maximum of 10%.

For different lengths of the at least one substrate 02, the adjusted position of the at least one frame 131, the at least one superstructure 129, the at least one supporting element 127, and the at least one directing element 126 can be stored in at least one storage device, and the substrate guiding device 125 can be adjusted based on the respective memory associated with a substrate length in the at least one storage device, preferably by the at least one drive 133; 142; 143; 144, more preferably by the at least one electric motor 133; 142; 143; 144.

The bearing friction of the at least one substrate 02 on the at least one directing element 126 is reduced by the partial separation and partial singulation of the at least one substrate 02 from the at least one holding pile 169 in the region of the at least one substrate guiding device 125 by the one at least partially flattened directing bar 134 onto at least one bearing element 139. In particular, at least one sheet-format substrate 02 is separated from the at least one holding pile 169 by the edge of the flattened directing bar 134, in conjunction with the decreased width of the at least one forward stop 162, and the at least one substrate 02 drops onto the bearing rail 136 having the at least one bearing element 139. As a result of the partial separation and/or at least partial singulation, the bottommost sheets 02 of the at least one holding pile 169 each rest on the at least one bearing rail 136 having the at least one bearing element 139. The at least one holding pile 169 is located partly on the at least one substrate guiding device 125 and partly on the at least one first substrate feed device 101. The partial separation takes place primarily in the region of the at least one substrate guiding device 125 and leads to a lightening of the weight on the bottommost sheet 02 of the at least one holding pile 169 in the region of the at least one substrate guiding device 125. In particular, bearing friction on the at least one substrate 02 is reduced and subsequent singulation in the at least one second substrate feed device 160 is facilitated.

By means of the at least one notch 137 in the at least one directing bar 134, at least one pushing device 138 of the at least one first substrate feed device 101 pushes the at least one substrate 02 against at least one forward wall 162 of the at least one second substrate feed device 160 and holds the at least one substrate 02 of the at least one holding pile 169 one on top of the other. In particular, the at least one pushing device 138 ensures that the substrate 02 of the at least one holding pile 169 lies precisely one on top of the other.

While a preferred embodiment of a transport device for a sheet-format substrate and a method for transporting at least one sheet-format substrate, in accordance with the present invention, has been set forth fully and completely hereinabove, it will be apparent to one of ordinary skill in the art that various changes could be made thereto, without departing from the true spirit and scope of the present invention, which is accordingly to be limited only by the appended claims.

The invention claimed is:

1. A transport device (100) for a sheet-format substrate (02) having at least one first substrate feed device (101) and having at least one second substrate feed device (160), wherein the at least one second substrate feed device (160) comprises at least one forward stop (162) and at least one singulating device (165), wherein at least one substrate guiding device (125) is located between the at least one first substrate feed device (101) and the at least one second substrate feed device (160) and wherein the at least one substrate guiding device (125) has at least one directing element (126), wherein the at least one directing element (126) is mounted such that it is movable and/or moved in two different directions independently of one another, wherein the at least one directing element (126) has at least one directing bar (134) which is mounted for rotational displacement, wherein a first of the two different directions has a greater vertical component than a second of the two different directions and wherein the second of the two different directions has a greater horizontal component than the first of the two different direction, and wherein the at least one directing element (126) is mounted at least operatively connected to at least one first linear guide (141) and to at least one second linear guide, and wherein the at least one directing element (126) is mounted for movement on the at least one first linear guide (141) and for movement on the at least one second linear guide independently of one another.

2. The transport device according to claim 1, characterized in that the at least one substrate guiding device (125) has at least one supporting element (127).

3. The transport device according to claim 2, characterized in that the at least one supporting element (127) is mounted operatively connected to at least one third linear guide or in that the at least one supporting element (127) is mounted operatively connected to the at least one first linear guide (141), and/or in that the at least one supporting element (127) is mounted operatively connected to at least one fourth linear guide (132) or in that the at least one supporting element (127) is mounted operatively connected to the at least one second linear guide.

4. The transport device according to claim 2, characterized in that at least one superstructure (129) comprises the at least one directing element (126) and the at least one supporting element (127) and is mounted for displacement at least in one direction, at least a part of which is a vertical direction (V), and in that at least one frame (131) comprises the at least one superstructure (129), and in that the at least one frame (131) is mounted for displacement at least in a direction which points toward the at least one first substrate feed device (101) and/or at least in a direction which points toward the at least one second substrate feed device (160) and/or at least in a direction of transport (T).

5. The transport device according to claim 4, characterized in that at least the frame (131) and/or the at least one directing element (126) and/or the at least one supporting element (127) and/or the at least one superstructure (129) are mounted such that each is displaceable by at least one drive (133; 142; 143; 144).

6. The transport device according to claim 1, characterized in that the at least one directing bar (134) has on its lateral surface at least one surface area which lies in one plane.

7. A transport device (100) for a sheet-format substrate (02) having at least one first substrate feed device (101) and having at least one second substrate feed device (160) which comprises at least one forward stop (162) and at least one singulating device (165), wherein at least one substrate guiding device (125) is located between the at least one first substrate feed device (101) and the at least one second substrate feed device (160), wherein the at least one substrate guiding device (125) has at least one directing element (126), and wherein the at least one directing element (126) is mounted operatively connected to at least one first linear guide (141) and to at least one second linear guide, wherein the at least one directing element (126) has at least one bearing rail (136), and wherein at least one bearing rail (136) has at least one bearing element (139) extending in thea transverse direction (A) of the transport device (100), and wherein the at least one bearing element (139) is arranged protruding away from the at least one bearing rail (136), which at least one bearing element (139) points at least in the direction of transport (T) of the transport device (100) and/or at least in a direction that points toward the at least one second substrate feed device (160).

8. A method for transporting at least one sheet-format substrate (02) using at least one first substrate feed device (101) and at least one second substrate feed device (160), wherein the at least one second substrate feed device (160) comprises at least one forward stop (162) and at least one singulating device (165), wherein downstream of the at least one first substrate feed device (101) and upstream of the at least one second substrate feed device (160), in a direction of sheet-format substrate travel, the at least one substrate (02) is transported via at least one substrate guiding device (125), wherein the at least one substrate guiding device (125) has at least one directing element (126), wherein the at least one directing element (126) is moved in two different directions independently of one another, and wherein the at least one substrate guiding device (125) has at least one supporting element (127), wherein the at least one supporting element (127) of the at least one substrate guiding device (125) supports the at least one substrate (02) against deflection and/or bending and/or for an adjustment to the thickness of the at least one substrate (02) for feeding to the at least one second substrate feed device (160), and wherein the at least one directing element (126) is displaced on at least one first linear guide (141) and on at least one second linear guide.

9. The method of transport according to claim 8, characterized in that the position of the at least one directing element (126) of the at least one substrate guiding device (125) is adjusted at least according to the length of the at least one substrate (02) and/or according to the deflection of the at least one substrate (02).

10. The method of transport according to claim 8, characterized in that the at least one supporting element (127) is displaced at least on at least one third linear guide or on the at least one first linear guide (141), and is additionally displaced on at least one fourth linear guide (132) or on the at least one second linear guide.

11. The method according to claim 8, characterized in that the at least one substrate (02) is transported via at least one superstructure (129), which comprises the at least one directing element (126) and the at least one supporting element (127) and/or the at least one substrate (02) is transported via at least one frame (131) which comprises the at least one superstructure (129).

12. The method according to claim 11, characterized in that for various substrate lengths, an adjusted position of the at least one frame (131), of the at least one superstructure (129), and of the at least one supporting element (127) and the at least one directing element (126) is stored in at least one storage device, and in that the substrate guiding device (125) is adjusted according to a respective memory associated with a substrate length in the at least one storage device.

* * * * *